United States Patent [19]

DeAngelis

[11] 3,990,135

[45] Nov. 9, 1976

[54] METHOD OF MOUNTING A PLUMBING FIXTURE

[76] Inventor: Costanzo DeAngelis, Box 829, Bluefield, Va. 24605

[22] Filed: Sept. 4, 1975

[21] Appl. No.: 610,449

Related U.S. Application Data

[62] Division of Ser. No. 431,075, Jan. 7, 1974, Pat. No. 3,905,052.

[52] U.S. Cl. ..... 29/157 R; 29/526; 85/1 K

[51] Int. Cl.[2] ..... B21D 53/00; B21K 29/00; B23P 15/26

[58] Field of Search..... 29/526, 157 R; 285/56, 285/58; 4/252 R, 68, 170; 85/1 K, 50 R, 51

[56] References Cited

UNITED STATES PATENTS

| | | | |
|---|---|---|---|
| 1,031,531 | 7/1912 | Cramer | 285/56 |
| 1,548,850 | 8/1925 | Rudolph | 285/56 |
| 2,176,411 | 10/1939 | Washer | 85/50 R UX |
| 2,932,037 | 4/1960 | Manas | 4/252 R |
| 2,942,277 | 6/1960 | Manas | 4/252 R |
| 3,579,670 | 5/1971 | Frank | 285/56 X |

FOREIGN PATENTS OR APPLICATIONS

| | | | |
|---|---|---|---|
| 556,758 | 10/1943 | United Kingdom | 85/1 K |

*Primary Examiner*—Charlie T. Moon
*Attorney, Agent, or Firm*—Charles W. Chandler

[57] ABSTRACT

A method for mounting a toilet bowl on a bathroom floor by attaching a hold-down ring to the floor with a pair of threaded studs projecting through and above appropriate openings in the toilet bowl flange. A nut having a blind hole is mounted on each stud and then screwed down with the stud to attach the toilet bowl to the hold-down ring flange.

3 Claims, 6 Drawing Figures

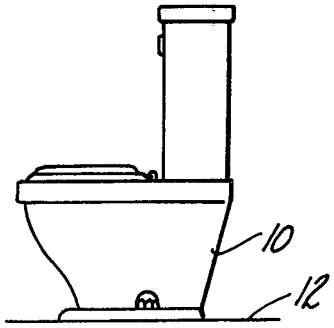
Fig-1
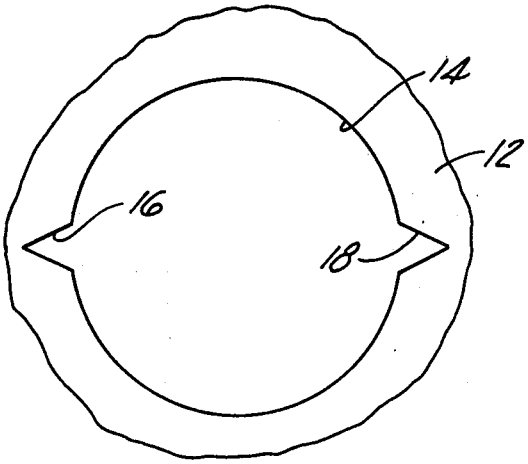
Fig-2
Fig-3
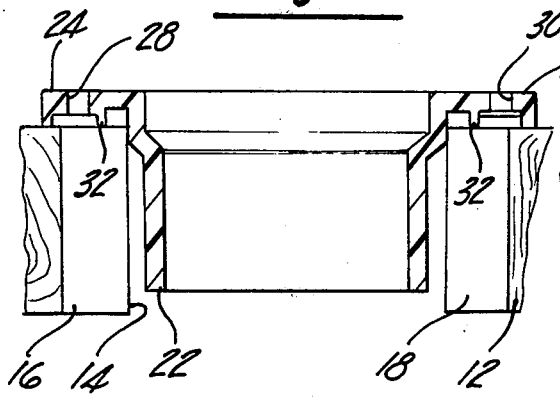
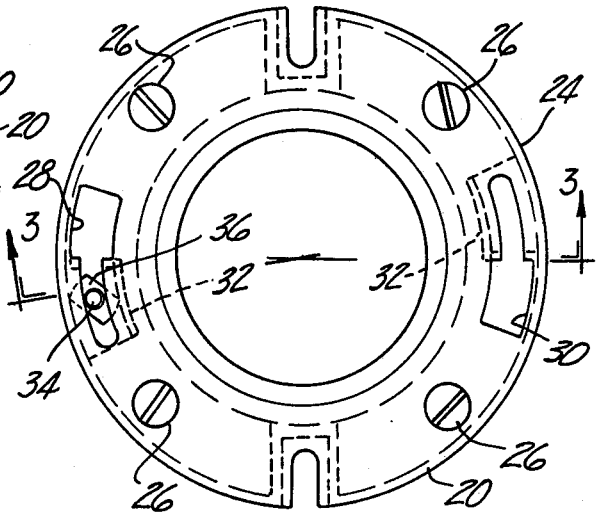
Fig-4
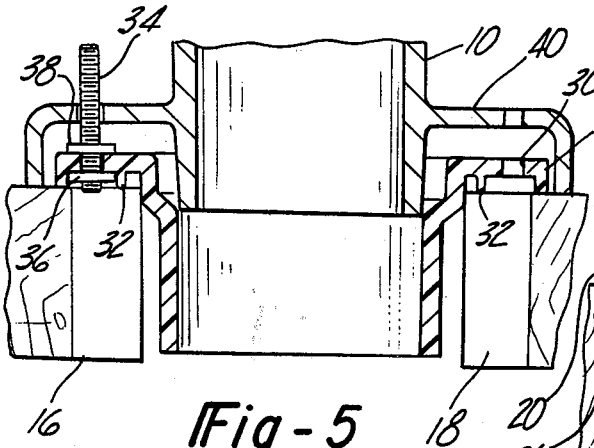
Fig-5
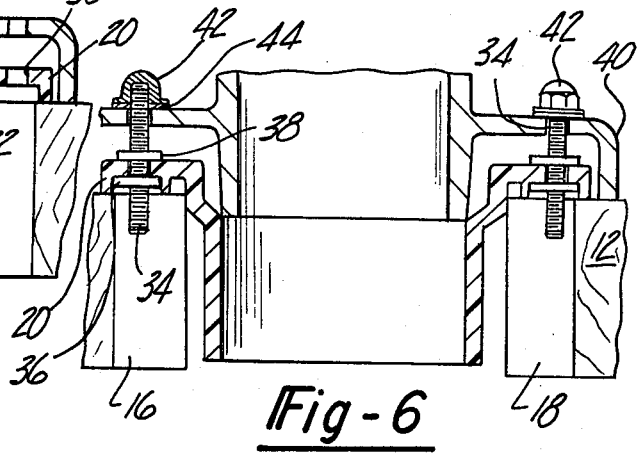
Fig-6

METHOD OF MOUNTING A PLUMBING FIXTURE

CROSS-REFERENCE TO RELATED APPLICATION

This application is a divisional application of pending application Ser. No. 431,075 filed Jan. 7, 1974, now U.S. Pat. No. 3,905,052.

BACKGROUND OF THE INVENTION

This invention is related to methods and apparatus for attaching a toilet bowl to a bathroom floor, and more particularly to a novel fastening apparatus in which the hold-down studs are screwed down into an opening in the floor in order to attach the toilet bowl to a hold-down flange mounted in the floor openings.

The conventional practice for mounting a toilet bowl to a bathroom floor is to form a floor opening in which a plastic hold-down ring is seated. The ring has a flange, and a tubular body connected to a drain pipe. A pair of screws are disposed on opposite sides of the floor opening so as to project up through the flange. The toilet bowl is mounted on the screws and then a nut is manipulated downward on each screw until the toilet bowl is securely fastened to the hold-down ring. Normally the upper end of each screw extends above its respective nut. This upper end of the screw is then cut off by the workman to provide a neat appearance.

SUMMARY OF THE INVENTION

The broad purpose of this invention is to eliminate the necessity of cutting off the excess length of the hold-down screws. The preferred embodiment of the invention provides a floor opening beneath each hold-down screw which is then screwed with the upper nut down into the floor opening as the toilet bowl is being fastened to the floor.

Still another object of the invention is to provide means for frictionally supporting the hold-down screw or stud in a raised above the floor opening until the top hold-down nut is mounted on the upper end of the stud.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which:

FIG. 1 — is a view of a conventional toilet bowl mounted on a bathroom floor in accordance with the method of the invention;

FIG. 2 — is a view of the hole formed in the floor in accordance with the preferred method;

FIG. 3 — is a sectional view illustrating the manner in which a conventional hold-down ring is mounted in the floor opening;

FIG. 4 — is a top opening of the hold-down ring;

FIG. 5 — is a view illustrating one of the hold-down studs mounted to receive its upper hold-down nut; and FIG. 6 — is a view illustrating the final position of the hold-down studs as they fasten the toilet bowl to the floor.

DESCRIPTION OF THE PREFERRED EMBODIMENT

Referring to the drawings, a conventional toilet bowl 10 is mounted on the floor 12 of a bathroom. In the preferred method, a circular opening 14 is formed in floor 12 with a pair of grooves 16 and 18 on opposite sides of the opening. Referring to FIG. 3, conventional plastic floor mounted flange or hold-down ring 20 is illustrated as having a tubular body 22 disclosed in opening 14, and a flange 24 seated on the floor about opening 14. As illustrated in FIG. 4, four threaded fasteners 26 attach ring 20 to floor 12 in the conventional manner. Flange 24 has a pair of elongated openings 28 and 30 disposed above grooves 16 and 18, respectively. It is to be noted that flange 24 has an integral ridge 32 adjacent each of the openings 28 and 30.

Referring to FIG. 5, an elongated metal stud 34 is disposed in opening 28. A flat nut 36 is threadably mounted on the lower end of stud 34 engaged with ridge 32. Ridge 32 prevents nut 36 from being rotated as stud 34 is being rotated.

A friction member 38 preferably formed of a rubber washer is mounted on stud 34 above flange 20. Member 38 has an inner diameter frictionally engaging the stud so that when in contact with upper flange 24, the friction member prevents the stud from falling downwardly through opening 16, and also retains nut 36 engaged with ridge 32 until the user can mount a nut on the upper end of the stud. A second stud 34 and friction member is also mounted in opening 30. The toilet bowl is then mounted on ring 20 so that appropriate openings in toilet bowl flange 40 receive the two studs.

Referring to FIG. 6, a nut 42 is then mounted on the upper end of each of the studs 34. Nut 42 has a blind opening so that it can be seated on the extreme upper end of the stud. The nut and the stud are then rotated downwardly until the nut engages a metal washer 44 on flange 40 of the toilet bowl so that both the toilet bowl flange and the hold-down ring flange are clamped tightly between upper nuts 42 and lower nuts 36. When both of the nuts 42 have been attached to their respective studs, the toilet bowl flange is then firmly attached to floor 12 as well as to the hold-down ring 20.

Thus it can be seen that any excess length of stud 34 is disposed in the opening beneath the hold-down ring thereby obviating the necessity of trimming the excess length as is required in the conventional practice.

I claim:

1. A method for mounting a toilet bowl on a floor comprising the steps of:

forming an opening in the floor;

disposing the body of a hold-down ring in a floor opening such that the hold-down ring flange is disposed on the floor about the floor opening, and then fastening the ring to the floor;

passing an elongated threaded member through an opening in the hold-down ring, and mounting a nut on the lower end of the threaded member beneath the hold-down ring flange;

mounting a friction member on the threaded member above the hold-down ring in a position so as to maintain the lower nut engaged with the hold-down ring flange to prevent it from dropping into the hole in the floor, mounting the toilet bowl on the hold-down ring with the studs in the openings in the flange of the toilet bowl, and mounting an upper nut having a blind opening on the upper end of the threaded member, and then rotating the upper nut and the threaded member whereby the hold-down flange and the toilet bowl are clamped between the upper nut and the lower nut.

2. A method as defined in claim 1, including mounting a metal washer between the upper nut and the toilet bowl.

3. A method as defined in claim 1, in which the opening in the hold-down ring flange has an elongated shape enlarged at one end to pass the lower nut between positions on opposite sides of the hold-down ring flange.

* * * * *